United States Patent [19]

Bartelt

[11] 4,026,495

[45] May 31, 1977

[54] ROTATING TUBING PAYOFF SYSTEM

[75] Inventor: Alan R. Bartelt, West Lafayette, Ind.

[73] Assignee: Aluminum Company of America, Pittsburgh, Pa.

[22] Filed: Feb. 2, 1976

[21] Appl. No.: 654,354

[52] U.S. Cl. ..... 242/129.62; 242/156

[51] Int. Cl.[2] ..... B65H 49/00

[58] Field of Search ..... 242/54 R, 75.42, 75.43, 242/129, 129.62, 129.8, 129.5, 156, 131

[56] References Cited

UNITED STATES PATENTS

| | | | |
|---|---|---|---|
| 2,316,798 | 4/1943 | Luebbe | 242/54 R |
| 3,323,752 | 6/1967 | Kurtz et al. | 242/129.8 |
| 3,477,661 | 11/1969 | Emerson et al. | 242/131 |
| 3,515,359 | 6/1972 | Norton | 242/129.8 |

*Primary Examiner*—Leonard D. Christian
*Attorney, Agent, or Firm*—Andrew Alexander; Elroy Strickland

[57] ABSTRACT

A system for paying off lengths of tubing in a rotating manner from a coiled supply comprises a structural, horizontal base with a vertical member having its lower end fixed to the base and its upper end supporting a cross member. A drum adapted to rotate on the cross member has one fixed rim and one removable rim to permit loading and locking of the coil supply on the drum. A channel located underneath the coiled supply is provided to guide the tubing from the coiled supply towards a work area. A brake means deactivated and activated by tension on the tubing controls the rotation of individual drums and coils as lengths of tubing are dispensed to a work area.

3 Claims, 4 Drawing Figures

ROTATING TUBING PAYOFF SYSTEM

BACKGROUND OF THE INVENTION

This invention relates to a system for paying off lengths of elongated product from a rotatable coiled supply. More particularly, the invention relates to a system for paying off lengths of small diameter tubing from a rotatable heavy coiled package containing about two miles of such tubing.

In providing lengths of thin walled air conditioning tubing to a hairpin bending machine, for example, it is imperative that the tubing be provided undamaged on a highly consistent basis. Damaged tubing can interfere with production and it can lead to failure of the tubing in service.

Dispensing undamaged lengths of aluminum tubing to a work area of a bending machine or other processing means can produce more difficulties than dispensing a solid product such as wire, for example, because the aluminum tubing is more susceptible to damage which can result in its rejection. For instance, the tubing can be rejected for being merely out of round, that is, no longer circular in cross section. Obviously, a solid product such as wire is resistant to forces, e.g. compressive forces, which would damage thin walled tubing. Thus, it can be seen that a system suitable for dispensing a solid product, for example, wire, may not be suitable for dispensing thin walled tubing because of the damage problems involved.

The thin walled aluminum tubing referred to is susceptible to damage in many ways, especially in view of the large coiled packages referred to above (desirable from an economic point of view) from which it is dispensed. For example, the tubing can be damaged when it is used as a means to rotate the coiled package to pay off lengths to the aforementioned bending machine. This damage comes about by having the outer winding of tubing on which the pull is exerted being forced or pulled into the inner windings. In this situation, tubing from the outer winding tends to abraid tubing in the inner windings thereby causing damage to it. Also there is a great likelihood of the tubing from the outer winding becoming stuck in the inner windings often requiring a greater pulling force than normal to rotate the coiled supply. Exerting this greater force to free the outer windings can buckle or kink or even break the tubing. Thus it can be seen that thin walled tubing can easily be damaged as a result of the outer windings becoming embedded in the inner windings. In addition to the problem of damaging the immediate tubing, the uniformity of the windings in the coiled supply can be disoriented, interfering with smooth, subsequent dispensing of the tubing.

An obvious expedient to avoid these problems would be a motor-driven mechanism which would rotate these large coiled packages to provide tubing at a rate commensurate with that required by the bending machine. However, that type of mechanism greatly complicates the process, adds to its cost and, in reality, negates the economic benefits derived from the use of these large coiled packages of tubing. For these reasons, such a mechanism is undesirable.

BRIEF SUMMARY OF THE INVENTION

Thus, the present invention is directed to a nonpowered pay-off system that is compact and low cost yet is capable of handling large packages of coiled tubing in a highly efficient manner. The system can be fabricated from quite inexpensive materials and components and thereafter can be operated with relative ease to provide lengths of undamaged tubing on a highly consistent basis. Also, the system fulfills a requirement presently needed in the industry and simultaneously solves many problems with respect to thin walled tubing of the type referred to above. The system comprises a structural, horizontally disposed base with a vertical member having its lower end rigidly fixed to the horizontal base and its upper end supporting a cross member. The system includes a spool or drum adapted to rotate on the cross member, which spool or drum has one fixed and one removable rim to permit loading and locking of the coiled supply on the drum. A channel is provided to guide the elongated product from the coiled supply to a work area and a brake means is utilized to stop rotation of the drum after paying off or dispensing a length of the elongated product.

BRIEF DESCRIPTION OF THE DRAWINGS

The objectives and advantages of this invention will be best understood from consideration of the following detailed description of the accompanying drawings in which.

DETAILED DESCRIPTION OF THE PREFERRED EMBODIMENTS

Figure 1:
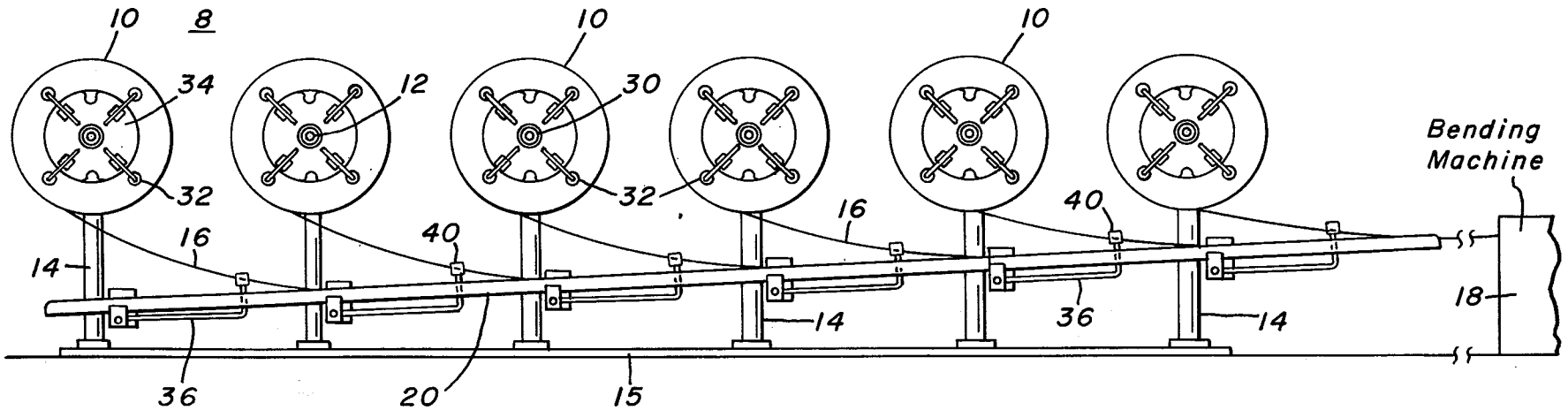
FIG. 1 is a side elevation view illustrating a dispensing system in accordance with the present invention.
Figure 3:
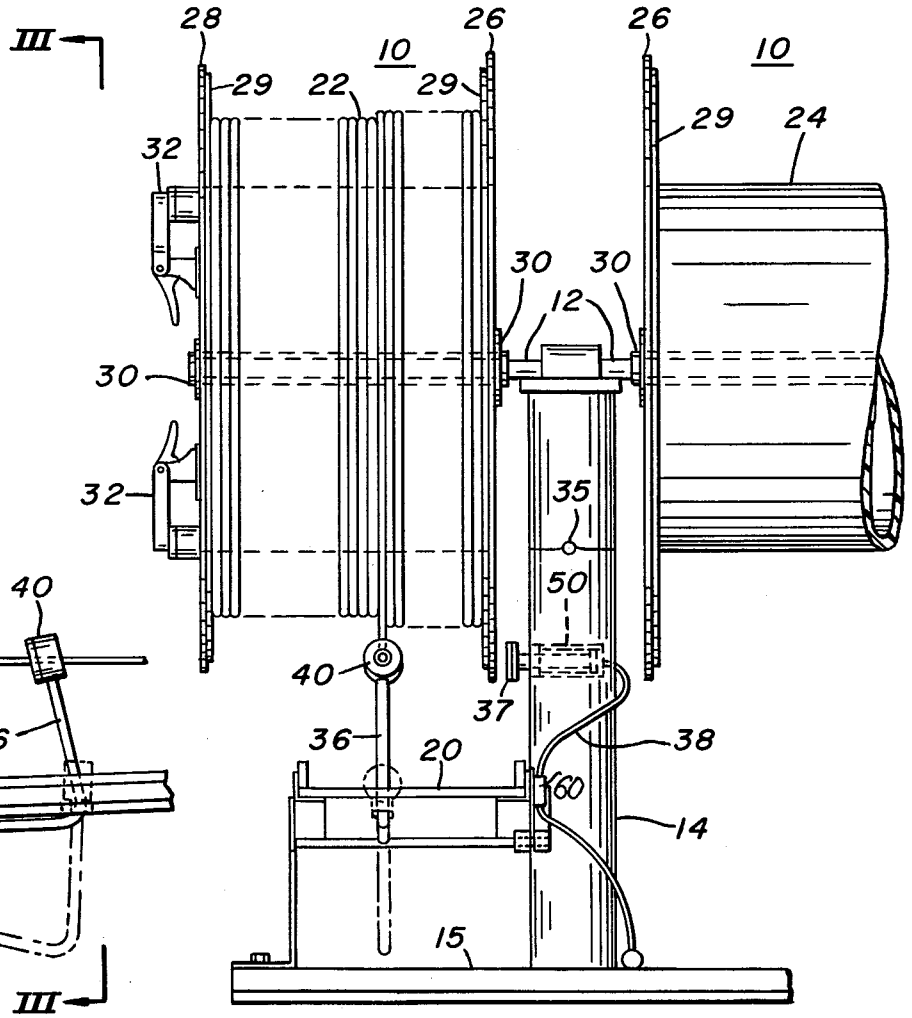
FIG. 3 is an end elevation view of the system taken along line III—III of FIG. 2.
Figure 2:
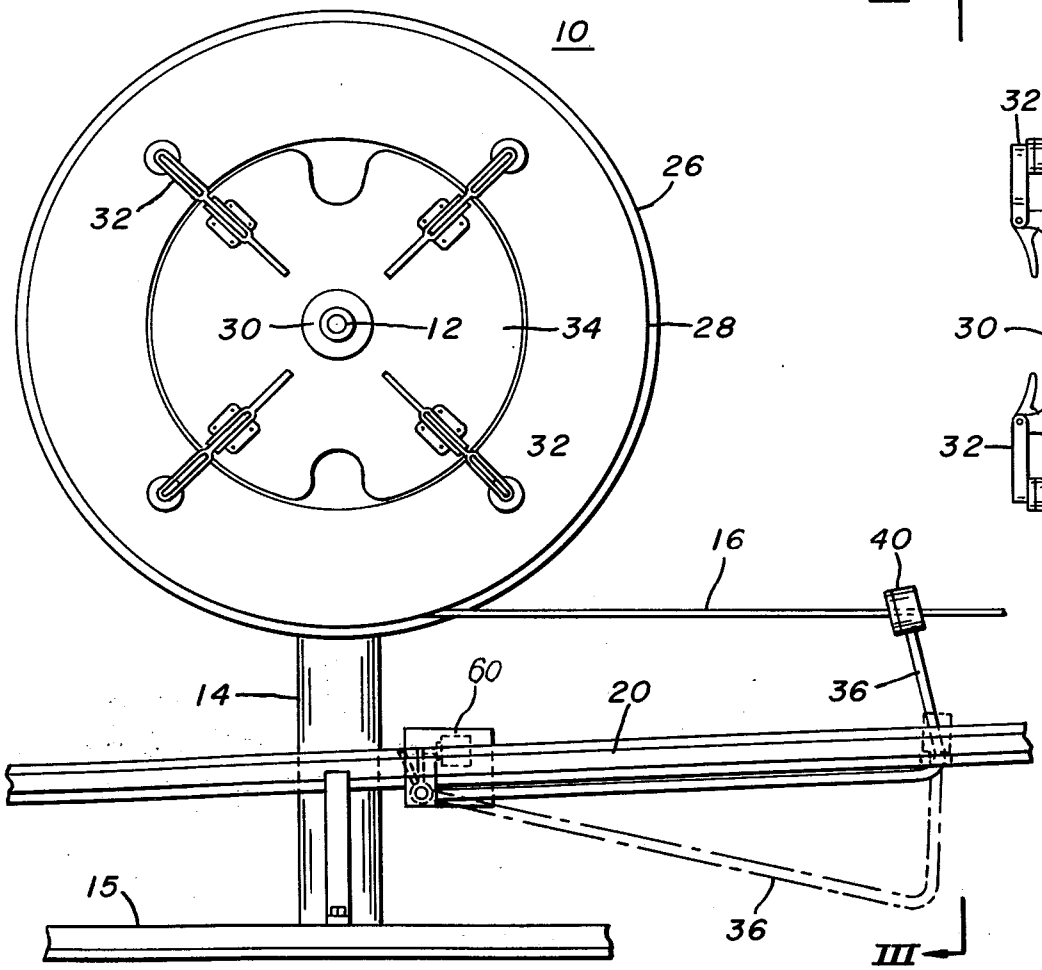
FIG. 2 is an enlarged view of a drum and braking system in accordance with the present invention.

Referring now more specifically to FIG. 1, there is shown a payoff or dispensing system 8 for elongated hollow product, such as thin walled aluminum air conditioning tubing. The system includes a series of drums or spools 10 each of which can carry a coiled supply containing about two miles of tubing. The drums 10, of which six pair are shown in FIG. 1, are positioned more or less in a straight line to pay off tubing 16 simultaneously to work station 18 by rotating about a substantially horizontal cross member 12. As can best be seen in FIG. 3, cross member 12 is supported at about its middle or halfway along its length by a vertical member 14 which is supported by a substantially horizontal, structural base member 15. Also, as will be observed from FIG. 3, the system is constructed so that cross member 12 acts as an axle for two drums 10. As shown in FIGS. 1, 2 or 3, the dispensing system 8 includes a channel or trough 20, located generally below the drums, which acts as a guide and support for tubing 16 as it is unwound from the coiled supply and directed towards work station 18.

In accordance with the present invention there is provided a brake means, generally referred to as 50 (FIG. 3), which cooperates with pay-off system 8 to permit only an amount of tubing 16 to be unwound as required by work station 18. That is, braking means 50 prevents excess tubing from being unwound and thus prevents buckling or other such deformation of tubing 16. As mentioned hereinabove , deformation of the tubing can lead to its rejection.

The tubing 16 referred to and which the subject system is particularly suited for dispensing is aluminum tubing having a small inside diameter and a relatively thin wall. For example, a typical outside diameter is about ⅜ inch and a typical wall thickness about 0.029 inch. Such tubing has a relatively high tensile strength enabling it to rotate the coiled supply 22 on drum 10 about cross member 12 as the bending machine 18 draws lengths of such tubing towards it. However, since the coiled supplies of the tubing weigh in the neighborhood of 400 lbs., it will be evident that it would not have sufficient rigidity to stop the rotation of drum 10, hence the need for the braking means 50.

Also, while tubing 16 has a tensile strength sufficient to rotate the drum and coiled supply, particularly with a full coil 22 (FIG. 3) there is not normally much margin for exceeding its tensile strength. Thus, if the tubing 16 between machine 18 and drum 10 is permitted to become loose or slack by allowing the drum to dispense, or pay off more than the machine 18 demands, tubing 16 can be broken or snapped on the next demand for tubing. The breaking or snapping can occur in addition to the kinking or bending as indicated hereinabove. However, the present invention, by use of the subject dispensing and braking means, obviates these problems and provides machine 18, in this instance a hairpin bending machine, with a more or less continued supply of undamaged tubing 16.

The system 8 can provide as many supplies of tubing as machine 18 can use. Machine 18 referred to in the instant case is a hairpin bender, Model VBHB-M3, made by Burr Oak Tool and Gauge Company of Sturgis, Mich. It is capable of cutting and bending six tubes at one time, thus permitting six separate supplies of tubing to be fed to it simultaneously, as indicated in FIG. 1.

For economic reasons, the coiled supply of tubing is not packaged for handling or shipping puroses, but instead the coils are made to retain their shape by use of bands or straps 25. The retaining straps are removed after the coils have been positioned on the drum 10.

Figure 4:
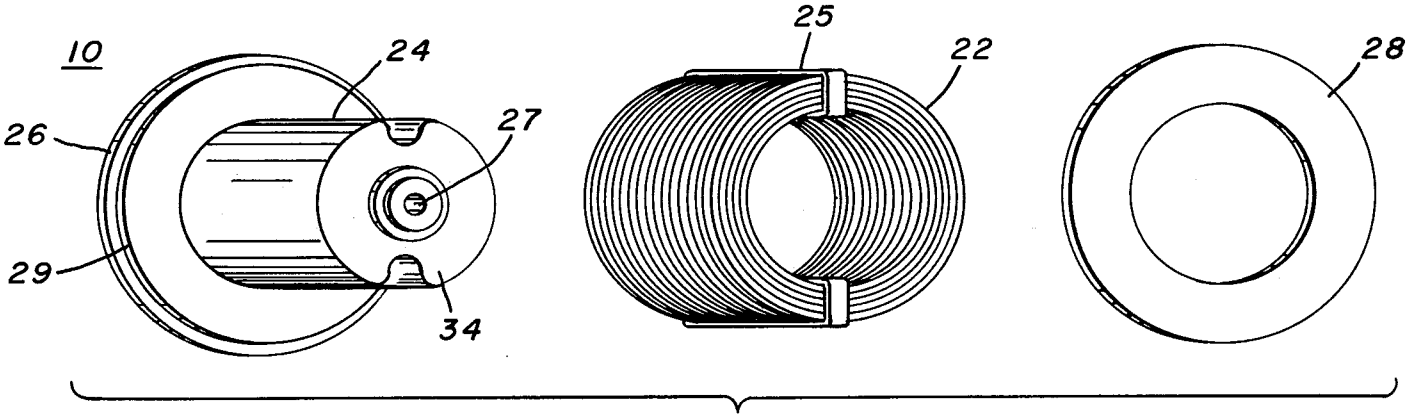
FIG. 4 is an exploded view of the drum, coiled supply and rim.

An important feature of the subject dispensing system is the drum or spool 10. By reference to FIG. 4, it will be noted that spool 10 has a generally cylindrical portion 24 which has a rim 26 attached at one end thereof and a removable rim 28 adapted to be attached at the other end. Cylindrical portion 24 has an axial hole 27 through which cross member or axle 12 is inserted when assembling the dispensing system. The sides 29 of rims 26 and 28 (FIG. 3) can have a layer of padding attached thereto to protect tubing 16 in contact therewith from abrasion. The cylindrical portion or center 24, rim sections 26 and 28 of spool 10 are preferably made from a high strength, light weight material, e.g. fiberglass reinforced plastic.

Once spool 10 is rotatably mounted on cross member 12 using bearings 30 to provide ease of rotation, a coiled supply 22 of tubing is placed on the cylindrical portion 24 of the spool 10. Thereafter, removable rim 28 having an opening corresponding in size to the diameter of the cylindrical portion 24 is attached or placed on the rim free end of spool 10 in such a way as to apply axial pressure to the coiled tubing. Having rim 28 fastened to apply such pressure ensures that the coiled package will stay tightly compacted and that the outer windings will not become embedded in the inner windings, thus avoiding the tubing deformation problems described hereinabove.

Rim 28 is held on the end of spool 10 by toggle-type fasteners 32, which are available from DASTACO of Detroit, Mich. The fasteners 32 are fixedly attached to end 34 of cylindrical portion 24 and upon placing rim 28 on end 34, fasteners 32 can engage rim 28 and force or lock it in firm contact with the coiled supply of tubing to provide the packing benefit as described above. In the present illustration, four fasteners 32 are shown; however, this number can be increased or decreased as desired.

The structure on which the drums or spools containing the coiled supply of tubing rotate, as mentioned earlier, consists of a more or less horizontal cross member 12 supported at about its middle by a vertical member 14 which is supported by a substantially horizontal base member 15. As illustrated in FIG. 3, cross member 12 carries two spools, one empty and one feeding or dispensing tubing to machine 18. The empty spool can be loaded with a coiled supply while the other drum is feeding tubing to the bending machine. Thus, a new coiled supply can be quickly moved into the dispensing position by merely rotating cross member 12 and spools through a 180° arc. Any type of bearing means 35 well known to those skilled in the art may be provided for ease of rotation of the new coiled supply from the non-dispensing position to the dispensing position. The bearing means 35 should have a locking device to ensure against the new coiled supply swinging or rotating past the dispensing or payoff position. Also, with reference to cross member 12, since the coiled supply can weigh 400 pounds or more, the cross member necessarily needs to be constructed from a high strength material.

A channel 20, provided underneath the dispensing drums, (FIGS. 1, 2 and 3) supports and guides tubing 16 to machine 18. Channel 20 should be fabricated from a relatively soft material, e.g. wood, which material will carry tubing 16 along its length with minimum damage. Preferably, channel 20 is sloped upwardly from the direction of drums 10 to machine 18 at an angle in the range of 3° to 7° .

In accordance with the present invention, braking mechanism 50 is provided to ensure against paying off or dispensing more tubing 16 than required by machine 18. In FIGS. 2 and 3, it will be observed that the braking mechanism comprises a disc brake pad 37, an activator arm 36 and air supply 38. The brake activating arm 36 is arranged so that a portion thereof projects upwardly through channel 20. This upwardly projecting portion of arm 36 has an opening 40 through which tubing 16 is passed. Once tension is applied to tubing 16 by virtue of machine 18 demanding tubing, activating arm 36 is raised upwardly away from channel 20 thereby disengaging brake pad 37 from rim 26 by operation of valve 60 thus allowing the drum to rotate. When the tension on the tubing 16 decreases, the activating arm 36 drops back towards channel 20 and allows the brake pad to engage the rim thereby stopping the rotation of the drum. In this method of activating or deactivating the brake, the payoff of each coiled supply is controlled individually which ensures that no more tubing than is required is dispensed. Also, in the present braking system, air pressure available in the plant can be utilized thus providing an exceptional economical, foolproof system.

To use dispensing system 8 to pay off tubing to a bending machine 18, for example, spools are mounted in pairs in a straight line substantially as shown in FIGS. 1 and 3. The number of pairs of spools 10 used is dependent on the capacity of the machine. A strapped coiled supply of tubing 16 is placed over cylindrical portion 24 by an overhead crane or some such means for lifting the coiled supply of tubing. Thereafter, rim 28 is placed on the end of cylindrical portion 24 and locked in place by toggle fasteners or clamps 32 thereby constraining the coiled supply. After fastening rim 28 in place, straps 25 used to maintain the coiled configuration while shipping can be removed. The end of the tubing on the outside of the supply is laced through the respective opening 40 in activating arm 36 and thereafter fed into the pulling mechanism of machine 18. The remaining drums 10 in the same row are loaded and the tubing fed to the pulling mechanism in the same manner and in this way initial operation of the payoff system is effected. While these supplies are being used up or depleted by machine 18, the empty drum on the corresponding arm of cross member 12 (FIG. 3) can be loaded with a fresh supply of tubing which, upon depletion of the original supply, can be swung into position by merely rotating cross member 12 about 180 ° and re-lacing the tubing to machine 18.

When dispensing system 8 is used with a bending machine as indicated hereinabove, the bending machine is used almost to the limit of its capacity. For example, when one coiled supply is depleted, the bending machine will continue to operate on the remaining coiled supplies and at any given time, it is only necessary to be re-loading one coiled supply of tubing. Also, downtime is limited merely to the time required to rotate the fresh supply into dispensing position, to lace tubing through the opening 40 in activator arm 36 and feed it into the machine, all of which can be accomplished in a matter of seconds.

It is this type of system which is highly economical by being relatively inexpensive to fabricate and to operate and by using the bending machine almost to the limit of its capacity.

While the invention has been described in terms of preferred embodiments, the claims appended hereto are intended to encompass all embodiments which fall within the spirit of the invention.

Having thus described my invention and certain embodiments thereof, I claim:

1. An arrangement for paying off thin walled tubing in a rotating manner from relatively large, heavy coiled supplies of the tubing, the arrangement comprising:

a structural base member disposed in a substantially horizontal manner;

a plurality of vertical members having their lower ends rigidly fixed to said base member at spaced apart locations therealong;

cross members;

means for respectively mounting the cross members on the upper ends of the vertical members in a manner that permits the cross members to rotate about the axes of the vertical members;

drums for respectively receiving coiled supplies of tubing, with each drum having one fixed and one removable rim thereon and releasable fasteners for holding the removable rim on the drum and firmly against the coiled supply on the drum, the drum being adapted to be mounted on a cross member to rotate about the axis of the cross member;

a channel member extending between the vertical members and adapted to guide tubing as it is pulled from the drums to a work area; and brake means adapted to engage each drum on its cross member when tension on the tubing being pulled from the drum is removed, and to disengage the drum when tension on the tubing occurs.

2. The system according to claim 1 wherein said drum and rims are fiberglass reinforced plastic.

3. The system according to claim 1 wherein said cross member is adapted to carry two drums of said coiled supply.

* * * * *